US009580226B2

(12) United States Patent
Ettlin

(10) Patent No.: US 9,580,226 B2
(45) Date of Patent: Feb. 28, 2017

(54) DISPENSING APPARATUS

(71) Applicant: Sulzer Mixpac AG, Haag (CH)

(72) Inventor: Josef Ettlin, Eichberg (CH)

(73) Assignee: SULZER MIXPAC AG, Haag (CH)

( * ) Notice: Subject to any disclaimer, the term of this patent is extended or adjusted under 35 U.S.C. 154(b) by 0 days.

(21) Appl. No.: 14/438,779

(22) PCT Filed: Aug. 20, 2013

(86) PCT No.: PCT/EP2013/067326

§ 371 (c)(1),
(2) Date: Apr. 27, 2015

(87) PCT Pub. No.: WO2014/067689

PCT Pub. Date: May 8, 2014

(65) Prior Publication Data

US 2015/0291340 A1 Oct. 15, 2015

(30) Foreign Application Priority Data

Oct. 29, 2012 (EP) ..... 12190339

(51) Int. Cl.
*B65D 81/32* (2006.01)
*B05C 17/005* (2006.01)
*B05C 17/01* (2006.01)

(52) U.S. Cl.
CPC .... *B65D 81/3211* (2013.01); *B05C 17/00503* (2013.01); *B05C 17/00553* (2013.01); *B05C 17/01* (2013.01); *B65D 81/3255* (2013.01)

(58) Field of Classification Search
CPC ..... B65D 81/3211; B65D 81/3255; B05C 17/00503; B05C 17/00553; B05C 17/01
(Continued)

(56) References Cited

U.S. PATENT DOCUMENTS 2,392,195 A * 1/1946 Shonnard ..... B65D 47/10 220/265
2,742,202 A * 4/1956 Dresden ..... B65D 47/10 222/541.2

(Continued)

FOREIGN PATENT DOCUMENTS

CN 101500905 A 8/2009
CN 102089084 A 6/2011

(Continued)

*Primary Examiner* — Donnell Long
(74) *Attorney, Agent, or Firm* — Global IP Counselors, LLP

(57) ABSTRACT

A dispensing apparatus has a storage container with two storage chambers which are closed by a closure element to a closed position and from which storage chambers components can be dispensed via component outlets in a dispensing position. A change from the closed position into the dispensing position is carried out by a rotation of the storage container with respect to the closure element. The storage container and the closure element are made in one piece in the closed position and are only connected to one another via connection webs. The connection webs are designed so that they tear off on a rotation of the storage container with respect to the closure element from the closed position into the dispensing position and thus the component outlets are opened.

12 Claims, 3 Drawing Sheets

(58) Field of Classification Search
USPC ..... 222/541.5, 541.6, 153.14, 153.06, 136, 222/386, 145.5, 145.6, 563
See application file for complete search history.

(56) References Cited

U.S. PATENT DOCUMENTS 5,152,432 A * 10/1992 De Laforcade .... B65D 81/3288 222/145.1
5,310,091 A * 5/1994 Dunning ..... B65D 81/325 222/135
5,429,723 A 7/1995 Atkinson
5,676,280 A * 10/1997 Robinson ..... B05C 17/00516 222/137
6,484,904 B1 * 11/2002 Horner ..... B05C 17/00513 222/137
6,874,661 B2 * 4/2005 Timmerman ..... B65D 81/325 215/253
8,020,728 B2 9/2011 Suchan et al.
8,281,956 B2 10/2012 Cadden
8,622,244 B2 1/2014 Stoeckli et al.
8,919,609 B2 * 12/2014 Wang ..... A61O 5/064 222/137
2005/0238408 A1 * 10/2005 Ramet ..... A45D 34/045 401/126
2008/0251535 A1 10/2008 Suchan et al.
2008/0314929 A1 * 12/2008 Keller ..... B05C 17/00506 222/145.6
2009/0272761 A1 11/2009 Cadden
2011/0056984 A1 * 3/2011 Cheetham ..... A61O 5/064 222/135

FOREIGN PATENT DOCUMENTS

DE 102007018143 B3 6/2008
EP 1 968 751 B1 4/2011
WO 2007/128996 A1 11/2007

* cited by examiner

DISPENSING APPARATUS

CROSS-REFERENCE TO RELATED APPLICATIONS

This application is a U.S. National stage application of International Application No. PCT/EP2013/067326, filed Aug. 20, 2013, which claims priority to EP Patent Application No. 12190339.7 filed Oct. 29, 2012, the contents of each of which are hereby incorporated herein by reference.

BACKGROUND

Field of the Invention

The invention relates to a dispensing apparatus for at least two flowable components.

Background Information

A dispensing device for two flowable components is described in EP 1 968 751 B1. The dispensing device has a storage container having a first storage chamber for a first component with a first component outlet and having a second storage chamber for a second component with a second component outlet. The dispensing device additionally has a closure element which is rotatable with respect to the storage container. The closure element can adopt a closed position and a dispensing position with respect to the storage container or the storage container can adopt a closed position and a dispensing position with respect to the closure element. The component outlets are closed in the closed position and the two component outlets are open in the dispensing position so that a dispensing of the components from the dispensing apparatus is possible via a dispensing opening. A change from the closed position into the dispensing position is carried out by a rotation of the storage container with respect to the closure element.

The component outlets are closed by flexible closure plugs of the closure element in the closed position of the closure element. On a rotation of the closure element from the closed position into the dispensing position, the closure plugs are pulled out of the dispensing openings and in so doing are highly deformed or bent.

SUMMARY

In light of this, it is the object of the invention to propose a dispensing apparatus which can be manufactured simply and inexpensively. In accordance with the invention, this object is satisfied by a dispensing apparatus for at least two flowable components, the dispensing apparatus having a storage container, a closure element, and a dispensing opening.

In accordance with the invention, the storage container and the closure element are designed in one piece in the closed position and are only connected to one another via connection webs. The named connection webs are in this respect designed and arranged so that they tightly close the component outlets on their own or together with other components of the closure element. The connection webs are thus a part of the closure element. The component outlets are, however, only tightly closed when the storage container has not yet been brought out of the closed position. If the storage container had already been rotated once with respect to the closure element, the connection webs can be torn off and the storage container and the closure element are thus present as separate parts. In this case, it is no longer ensured that the component outlets are tightly closed even when the storage container is located in the closed position. The dispensing apparatus is therefore in particular only provided for a single use.

The connection webs are designed so that they are torn off on a rotation of the storage container from the closed position into the dispensing position and thus the component outlets are open. The connection webs can therefore not be stretched or elongated so far that they do not tear off on the named rotation. The closure element is designed for this purpose so that the components can then be dispensed via the component outlet associated with them and subsequently via the dispensing opening.

It is thus advantageously possible to manufacture the storage container and the closure element together, in particular by an injection molding process. No separate closure element is thus necessary so that the dispensing apparatus can be manufactured particularly inexpensively.

In the dispensing apparatus in accordance with the invention, no flexible closure plugs are required for the closing of the component outlets. Such closure plugs are only complex and thus expensive to manufacture.

Furthermore, the dispensing apparatus has a particularly small loss volume. The loss volume is to be understood as the quantity of the components which cannot be dispensed from the dispensing apparatus and thus remain unused in the dispensing apparatus. The total volume of a closure plug which is received in a dispensing opening in the closed position is part of the loss volume. Since no closure plug is necessary with the dispensing apparatus in accordance with the invention, the loss volume is correspondingly smaller.

The storage chambers in particular have a hollow cylindrical inner contour in which a respective piston is arranged which can be displaced in the direction of a component outlet, and thus in the direction of a dispensing direction, for dispensing the components. The piston can in particular be displaced by hand.

Corresponding marks or abutments can be provided at the storage container or at the closure element for marking the closed position and the dispensing position of the storage container with respect to the closure element. A rotation of the storage container by 90° with respect to the closure element may, for example, be necessary for setting the dispensing position starting from the closed position. Other rotational angles are, however, also possible.

It is generally possible that the storage container can be rotated out of the closed position in both directions with respect to the closure element. It is, however, also possible that only a rotation in one direction is possible. In addition, a security against turning back can be provided so that a rotation into the closed position is no longer possible after setting the dispensing position. It can thus be ensured that the dispensing apparatus can only be used one single time.

The storage container and thus also the closure element can be manufactured, for example, from cyclic olefin copolymer (abbreviation: COC) or from polyoxymethylene (abbreviation: POM). The connection webs then have a length, for example, of approximately 1 mm with a thickness of approximately 0.15 mm. The other parts of the dispensing apparatus can comprise polypropylene (abbreviation: PP), for example.

The dispensing apparatus can be used for the most varied purposes. Applications are, for example, possible in the dental sector or also in the skin care sector. A cream for application to the skin can, for example, be mixed and dispensed by means of the dispensing apparatus, with which additional components such as vitamins are only admixed with a base cream shortly before the dispensing.

The first storage chamber is in particular arranged coaxial to the second storage chamber and surrounds it at least in part. The storage container thus in particular has a mainly cylindrical basic shape. With a cylindrical outer contour of the closure element, this allows a particularly effective utilization of space. The first storage chamber, that is the outer storage chamber, in this respect in particular has two component outlets.

The two storage containers can, however, also be designed in another manner. They can, for example, be arranged in parallel next to one another.

In an embodiment of the invention, the closure element has an outer part within which a closure web is arranged which is connected to the storage container via the connection webs. The outer part in particular has a mainly hollow cylindrical basic shape and the closure web connects two oppositely disposed sides of the outer part. The closure web in particular has a different width over its length. It in particular has closure regions which correspond to the component outlets, that is are designed so that they can close the component outlets in the closed position. The named closure regions are then connected to one another, with the connections being less wide. Since the component outlets usually have circular diameters, the corresponding closure regions also have a circular, somewhat larger diameter.

It is possible by the named design of the closure element with an outer part and a closure web that comparatively little material is required for the manufacture of the closure element, which allows an inexpensive manufacture of the combination of closure element and storage container. In addition, it is possible in a simple manner by this design that the components can flow from the component outlets in the direction of the dispensing opening in the dispensing position.

In an embodiment of the invention, the closure element is connected to a dispensing element which has the dispensing opening, with the closure element in particular being rotationally fixedly connected to the dispensing element. The rotation of the storage container with respect to the closure element is usually carried out by hand. This means that the closure element has to be held tight so that a rotation of the storage container relative to the closure element can take place. The closure element can be fixed via the dispensing element by the rotationally fixed connection to the dispensing element. A simple handling of the dispensing apparatus is thus made possible.

In an embodiment of the invention, the dispensing apparatus has a plug which is designed so that it can be inserted into the dispensing opening such that it is closed and which can serve as a handle for an applicator for dispensing the components. The applicator is designed, for example, as a brush by means of which the mixed components can be removed via the dispensing opening and can be applied at a desired site. The dispensing opening can thus be reliably closed.

The dispensing element and the applicator are in particular designed so that the applicator is arranged within the dispensing element when the plug closes the dispensing opening. The applicator can thus be arranged in a protected manner within the dispensing elements.

In an embodiment of the invention, the dispensing apparatus has a mixer with a mixer housing and with a mixing element, said mixer being arranged so that the components can be supplied to it after the dispensing from the component outlets. The components are thus mixed particularly thoroughly prior to the dispensing from the dispensing opening. The mixer is in particular designed as a static mixer.

In an embodiment of the invention, the mixer housing is designed as a part of the dispensing element. A separate mixer housing is thus not necessary, which allows a particularly inexpensive manufacture of the dispensing apparatus.

In an embodiment of the invention, the dispensing element has a dispensing chamber and the mixer is arranged between the storage container and the dispensing chamber. In the dispensing position of the storage container, the two components can thus be pressed through the mixer into the dispensing chamber from which it can be removed via the dispensing opening by means of a the named applicator, this is by means of a brush, for example. A good mixing can thus be achieved, on the one hand, and a direct removal of the mixed components, on the other hand.

It is, however, also possible that no mixer is provided and that the dispensing element nevertheless has a dispensing chamber. In this case, the components pressed into the dispensing chamber can be mixed, for example by shaking or by stirring with the applicator, and can subsequently be removed using the applicator.

It is also possible that the closure element has no special dispensing chamber. In this case, the mixing housing forms the dispensing opening so that the components are dispensed directly after the mixing by the mixing element via the dispensing opening.

In an embodiment of the invention, the closure element is arranged completely within the dispensing element and the storage container is arranged partly within the dispensing element. A particularly compact design of the dispensing apparatus is thus made possible. The rotationally fixed connection can in particular thus be implemented simply between the closure element and the dispensing element. The storage element for this purpose, for example, has one or more grooves into which corresponding projections of the dispensing element engage in the assembled state of the dispensing apparatus. The dispensing element, the closure element and the storage container in particular have circular outer contours at least sectionally.

In an embodiment of the invention, the dispensing apparatus has an actuation element which includes a first and a second piston. The first piston is displaceably arranged in the first storage chamber and the second piston is displaceably arranged in the second storage chamber. The two components can be pressed through the component outlets in the direction of the dispensing opening by displacing the pistons in the direction of the dispensing opening, that is in the dispensing direction. The displacement in this respect in particular takes place by hand. The actuation element is in this respect arranged partly within the storage container so that a particularly compact design of the dispensing apparatus results. The actuation element in particular also has an at least sectionally circular outer contour.

Further advantages, features and details of the invention result with reference to the following description of embodiments and with reference to drawings in which elements which are the same or have the same function are provided with identical reference numerals.

BRIEF DESCRIPTION OF THE DRAWINGS

Referring now to the attached drawings which form a part of this original disclosure.

DETAILED DESCRIPTION OF EMBODIMENTS

Figure 1:
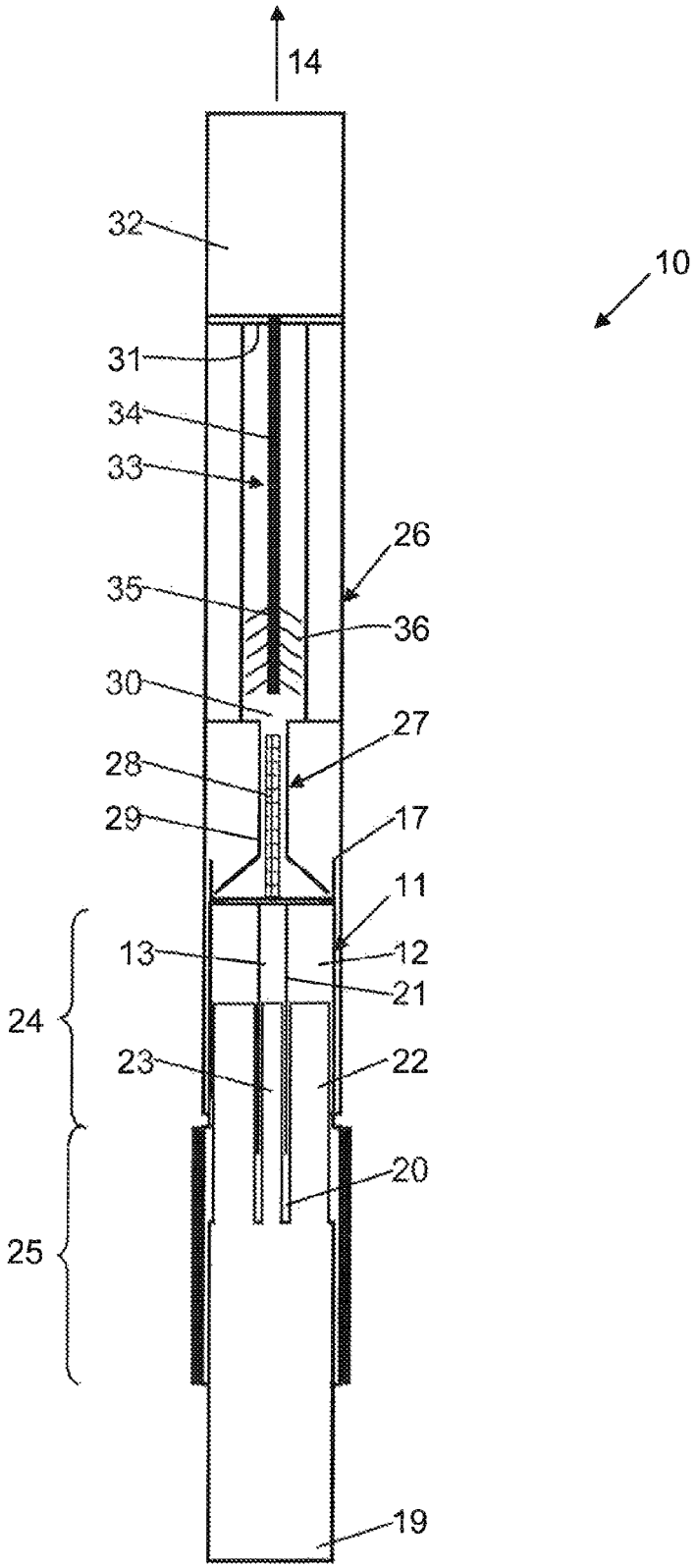
FIG. 1 is a schematic sectional representation of a dispensing apparatus.

In accordance with FIG. 1, a dispensing apparatus 10 has a storage container 11 for two flowable components. The storage container 11 has a first storage chamber 12 for a first flowable component and a second storage chamber 13 for a second flowable component. The storage chambers 12, 13 each have a hollow cylindrical inner contour and are arranged coaxial to one another and in parallel to a dispensing direction 14. The first storage chamber 12 completely surrounds the second storage chamber 13. The first storage chamber 12 has first component outlets 15 oriented in the dispensing direction 14 and the second storage chamber 13 has a component outlet 16 oriented in the same manner. The component outlets 15 and 16 are not shown in FIG. 1.

The storage container 11 is manufactured in one piece with a closure element 17 by means of an injection molding process. The storage container 11 and the closure element 17 are in this respect connected via connection webs 18 not shown in FIG. 1. The storage container 11 can adopt a closed position with respect to the closure element 17 and the component outlets 15, 16 are closed in this closed position. The storage container 11 is brought into a dispensing position by rotating the storage container 11 by 90° with respect to the closure element 17, in which dispensing position the component outlets 15, 16 are open and thus the components can be discharged from the storage chambers 12, 13 via the component outlets 15, 16. The named closure position and the dispensing position will be looked at in more detail in connection with FIGS. 2, 3 and 4.

The storage chambers 12, 13 are closed against the dispensing direction 14 by an actuation element 19 which likewise has a mainly cylindrical basic shape. The actuation element 19 has a hollow cylindrical cut-out 20 which is open in the dispensing direction 14 and which is arranged so that a likewise hollow cylindrical boundary wall 21 bounding the second storage chamber 13 dips into it. A first piston 22 and a second piston 23 are thus formed for the first and second storage chambers 12, 13. The actuation element 19 projects against the dispensing direction 14 from the storage container 11 so that it can be displaced by hand in the dispensing direction with opened component outlets 15, 16 and the components can thus be pressed out of the storage chambers 12, 13 by means of the pistons 22, 23.

The storage container 11 has a first section 24 and a second section 25 viewed in the dispensing direction 14, with both sections 24, 25 having a cylindrical basic shape and the first section 24 being arranged before the second section 25 viewed in the dispensing direction 14. The first storage 24 has a somewhat smaller diameter than the second section 25 and is almost completely arranged within a dispensing element 26 which likewise has a mainly cylindrical basic shape. The closure element 17 adjoins the first section 24 of the storage container 11 and likewise has a mainly cylindrical basic shape with the same diameter as the named first section 24 of the storage container 11. The closure element 17 is rotationally fixedly connected to the dispensing element 26, whereas the storage container 11 can be rotated with respect to the dispensing element 26 and thus also with respect to the closure element 17. The rotation is usually carried out by hand. So that a better grip is possible in this respect, the second section 25 of the storage container 11 has furrows, not shown in more detail, extending in the dispensing direction 14.

The dispensing element 26 has a static mixer 27 which is arranged partly within the closure element 17 and completely within the dispensing element 26. The mixer 27 has a mixing element 28 and a mixer housing 29. The mixer housing 29 has a funnel-like basic shape, with the funnel opening in the direction of the storage container 11. The mixing element 28 which is designed in one piece with the closure element 17 is arranged in the narrow part of the funnel. The components discharged via the component outlets 15, 16 are led to the mixing element 28 by the funnel shape of the mixer housing 29 so that the components are thoroughly mixed by the mixer 27. The mixing element and the closure element can also be designed as separate components.

In the dispensing direction 14, the mixer housing 29 opens into a cylindrical dispensing chamber 30 which has a smaller diameter than the dispensing element 26. The dispensing chamber 30 and thus the dispensing element 26 have a dispensing opening 31 in the dispensing direction 14 which is closed by means of a plug 32 in FIG. 1. The plug 32 also serves as a handle for an applicator 33 in the form of a brush with a shaft 34 and brush head 35 with bristles 36. In the inserted sate of the applicator 33 shown in FIG. 1, the shaft 34 is oriented in the dispensing direction 14 and the applicator 33 is arranged completely within the dispensing chamber 30 and thus within the dispensing element 26. The shaft 34 of the applicator 33 is so long that the brush head 35 reaches almost completely up to the mixer 27 in the inserted state. The discharged components mixed by the mixer 27 can thus be received by the applicator 35 in the dispensing chamber 30 and can be removed from the dispensing apparatus 10 via the discharge opening 31.

It is not necessarily necessary that a mixer is arranged between the component outlets of the storage chambers and of the storage chamber. It is equally possible that the two components move unmixed into the dispensing chamber and are mixed there by shaking the dispensing device, which is in particular closed, or by stirring with the applicator.

Figure 2:
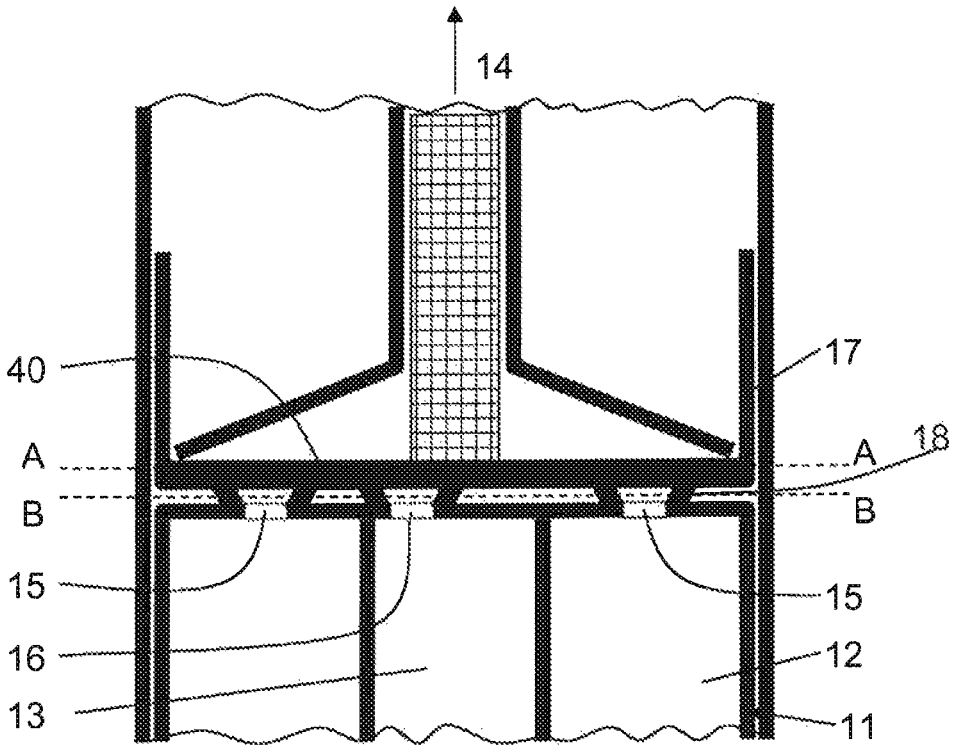
FIG. 2 is an enlarged a detail of the dispensing apparatus in FIG. 1.

A detail in the region of the component outlets 15 and 16 is shown more exactly in FIG. 2, with the storage container 11 being located opposite the closure element 17 in the closed position. The component outlet 16 of the second storage chamber 13 is not arranged centrally with respect to the storage chamber 13, but is rather arranged displaced to the outside left in FIG. 2. The opening of the dispensing opening 16 is thus made possible by a rotation of the storage container 11 with respect to the closure element 17 as will be explained below in connection with FIGS. 3 and 4.

The closure element 17 is only connected to the storage container 11 via connection webs 18 which extend around the circular component outlets 15, 16. The connection webs 18 are slightly outwardly inclined viewed in the dispensing direction 14 so that they have the outer contour of a truncated cone. The connection webs 18 end at a closure web 40 viewed in the dispensing direction 14. The component outlets 15, 16 are thus closed in the closed position shown by the connection webs 18 and the closure web 40 of the closure element 17. The dispensing position of the storage container 11 can be set by a rotation of the storage container 11 by 90° with respect to the closure element 17. During this rotation, the connection webs 18 tear off in a tearing plane which extends through the line B-B perpendicular to the dispensing direction 14 so that the component outlets 15 and 16 are opened.

In contrast to the representation in FIG. 2, the connection webs can also not have a uniform thickness or width, but rather a region having a smaller thickness in which the connection webs then tear off on the rotation. This region then represents a desired break point, so-to-say. The connection webs can also become thinner and thinner in one direction, in particular in the direction of the storage container.

Figure 3:
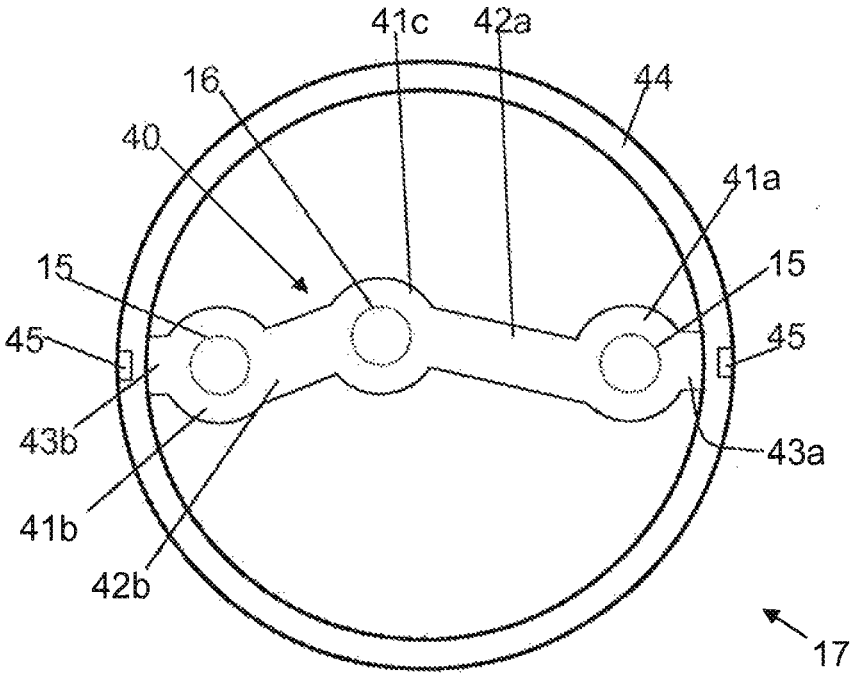
FIG. 3 is a plan view of a section along the line A-A in FIG. 2, that is with closed component outlets.

A section along the line A-A in FIG. 2 is shown in FIG. 3, with the storage container 11 likewise being in the closed position. In this sectional representation, only the closure element 17 is shown; the representation of the dispensing element 26 has been omitted. The component outlets 15, 16 are shown in broken lines in FIG. 3. The component outlets 15, 16 are covered by the closure web 40 in the closed position. The closure web 40 does not have a constant width, but rather has a total of three approximately round closure regions 41*a*, 41*b*, 41*c* which have a somewhat larger diameter than the corresponding component outlets 15, 16 disposed thereunder. The closure regions 41*a*, 41*b*, 41*c* are connected to connection pieces 42*a* and 42*b*. The width of the connection pieces 42*a* and 42*b* is in this respect smaller than the diameters of the closure regions 41*a*, 41*b*, 41*c*. The outwardly disposed closure regions 41*a* and 41*b* of the closure webs 40 are connected via connector pieces 43*a*, 43*b* to a hollow cylindrical outer part 44 of the closure element 17. The closure web 40 thus connects two oppositely disposed sides of the outer part 44.

The three closure regions 41*a*, 41*b*, 41*c* of the closure web 40 and thus also the component outlets 15, 15 in this respect do not lie on a straight line. The component outlets 15 of the first storage chamber 12 lie on a diameter of the hollow cylindrical outer part 44, whereas the second component outlet 16 neither lies on this diameter nor has the same spacing from the two outwardly disposed component outlets 15 of the first storage chamber.

The hollow cylindrical outer part 44 has two oppositely disposed, outwardly open cut-outs 45 which extend in the dispensing direction. In the assembled state of the dispensing apparatus 10, corresponding webs, not shown, of the dispensing element 26 engage into these cut-outs 45. A rotationally fixed connection is thus established between the outer part 44 and the dispensing element 26 and thus between the closure element 17 and the dispensing element 26.

Figure 4:
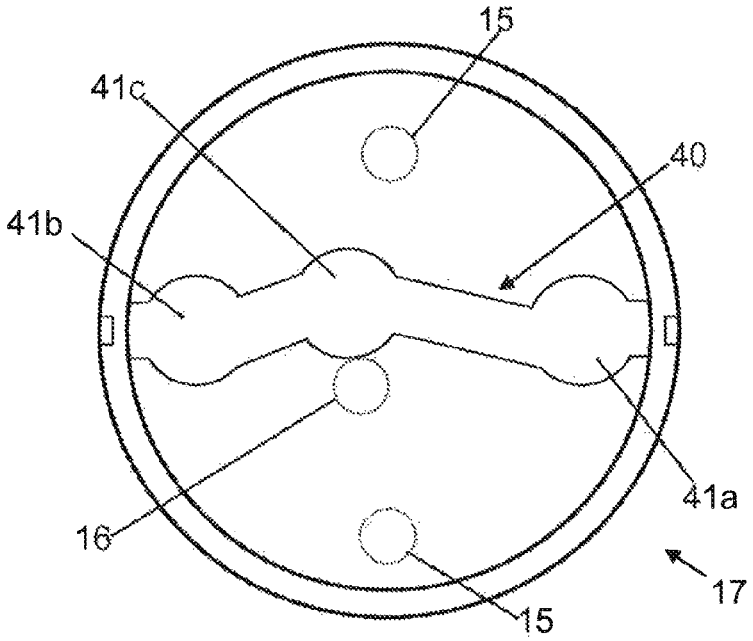
FIG. 4 is a plan view corresponding to FIG. 3 with opened component outlets.

The dispensing position shown in FIG. 4 is set by a rotation of the storage container 11 by 90° counter clockwise with respect to the closure element. The connection webs 18 tear off in this respect as described, whereby the rotation first becomes possible at all. As can be seen in FIG. 4, the named closure regions 41*a*, 41*b*, 41*c* are now no longer arranged above the dispensing openings 15, 16. There is no overlap at all between the dispensing openings 15, 16 and the closure web 40. On a displacement of the dispensing element 19 in the actuation direction 14, the components can thus exit the dispensing openings 15, 16, and flow past the closure web 40 to the mixer 27.

Figure 5:
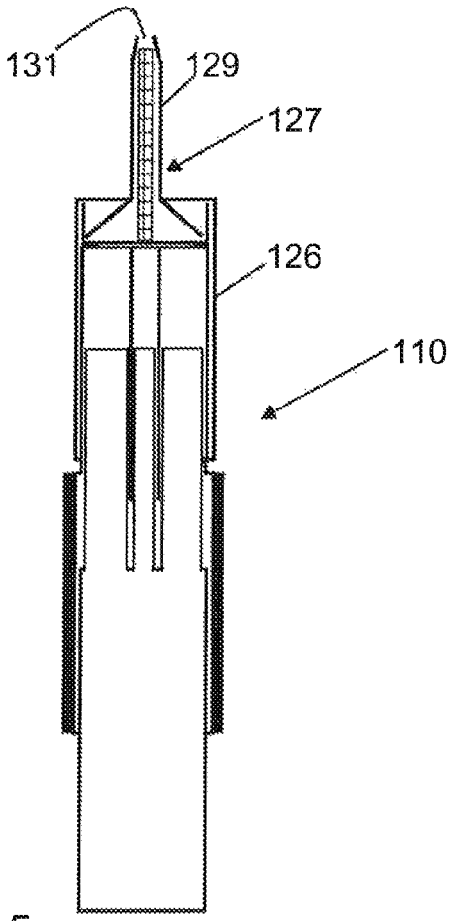
FIG. 5 is an alternative embodiment of a dispensing apparatus in accordance with the invention.

An alternative embodiment of a dispensing apparatus in accordance with the invention is shown in FIG. 5. The dispensing apparatus 110 generally has the same design as the above-described dispensing apparatus 10 so that only the differences between the two dispensing apparatus will be looked at.

In contrast to the dispensing element 26 of the dispensing apparatus 10, a dispensing element 126 of the dispensing apparatus 110 of FIG. 5 does not have a dispensing chamber into which the components move in the mixer 127 after the mixing. A mixer housing 129 of the mixer 127 rather already has a dispensing opening 131 via which the mixed components can be dispensed from the dispensing apparatus 110.

The invention claimed is:

1. A dispensing apparatus for at least two flowable components, the dispensing apparatus comprising:

a storage container having a first storage chamber configured to hold a first component and having a first component outlet, and having a second storage chamber configured to hold a second component and having a second component outlet;

a closure element; and a dispensing opening, the storage container being rotatable with respect to the closure element, the storage container being configured to adopt a closed position with respect to the closure element, in the closed position, the first and second component outlets being closed by the closure element, and the storage container being configured to adopt a dispensing position, in the dispensing position, the first and second component outlets being open and being configured to dispense the first and second components via the dispensing opening and the storage container being configured so as to change from the closed position into the dispensing position by a rotation of the storage container with respect to the closure element, and the storage container and the closure element being one piece in the closed position and only connected to one another via connection webs, the connection webs being configured so as to tear off on a rotation of the storage container from the closed position into the dispensing position.

2. The dispensing apparatus in accordance with claim 1, wherein the first storage chamber is coaxial to the second storage chamber and at least partially surrounds the second storage.

3. The dispensing apparatus in accordance with claim 1, wherein the closure element has an outer part, a closure web being disposed within the outer part and being connected to the storage container via the connection webs.

4. The dispensing apparatus in accordance with claim 1, wherein the closure element is connected to a dispensing element which has the dispensing opening.

5. The dispensing apparatus in accordance with claim 4, wherein the closure element is rotationally fixedly connected to the dispensing element.

6. The dispensing apparatus in accordance with claim 5, further comprising a plug, the plug being configured so as to be insertable into the dispensing opening such that the dispensing opening is closed and the plug serves as a handle for an applicator for dispensing the components.

7. The dispensing apparatus in accordance with claim 4, further comprising a mixer having a mixer housing and a mixing element, the mixer being arranged so that the components are supplied thereto after dispensing from the component outlets.

8. The dispensing apparatus in accordance with claim 7, wherein the mixer housing is a part of the dispensing element.

9. The dispensing apparatus in accordance with claim 8, wherein the dispensing element was a dispensing chamber and the mixer is disposed between the storage container and the dispensing chamber.

10. The dispensing apparatus in accordance with claim 4, wherein the closure element is disposed completely within the dispensing element, and the storage container is disposed partly, within the dispensing element.

11. The dispensing apparatus in accordance with claim 10 further comprising an actuation element, the actuation element including a first piston and a second piston, the first piston being displaceably arranged in the first storage chamber and the second piston being displaceably arranged in the second storage chamber, the actuation element being arranged partly within the storage container.

12. A dispensing apparatus for at least two flowable components, the dispensing apparatus comprising:

a storage container having a first storage chamber configured to hold a first component and having a first component outlet, and having a second storage chamber configured to hold a second component and having a second component outlet;

a closure element; and a dispensing opening, the storage container being rotatable with respect to the closure element, the storage container being configured to adopt a closed position with respect to the closure element, in the closed position, the first and second component outlets being closed by the closure element, and the storage container being configured to adopt a dispensing position, in the dispensing position, the first and second component outlets being open and being configured to dispense the first and second components via the dispensing opening and the storage chamber being configured so as to change from the closed position into the dispensing position by a rotation of the storage container with respect to the closure element, the storage container and the closure element being one piece in the closed position and only connected to one another via connection webs, the connection webs being configured so as to tear off on a rotation of the storage container from the closed position into the dispensing position, and the closure element having an outer part, and a closure web disposed within the outer part and connected to the storage container via the connection webs.

* * * * *